United States Patent [19]

Fox

[11] 3,955,585

[45] May 11, 1976

[54] SAFETY SMOKING DEVICE

[76] Inventor: Alvin F. Fox, 404 SW. Bay Blvd., Newport, Oreg. 97365

[22] Filed: May 12, 1975

[21] Appl. No.: 576,427

Related U.S. Application Data

[63] Continuation of Ser. No. 425,155, Dec. 17, 1973, abandoned.

[52] U.S. Cl. ..... 131/186; 131/175

[51] Int. Cl.[2] ..... A24F 13/14

[58] Field of Search ..... 131/174, 175, 186, 238, 131/239, 260; 70/63; 16/128 A, 168

[56] References Cited

UNITED STATES PATENTS

| | | | |
|---|---|---|---|
| 1,364,548 | 1/1921 | Fisher | 70/63 |
| 1,393,139 | 10/1921 | Kiesel | 16/168 X |
| 1,749,467 | 3/1930 | Dann | 131/238 |
| 1,851,899 | 3/1932 | Foote | 131/186 X |
| 2,625,163 | 1/1953 | Jones et al. | 131/175 |
| 2,774,098 | 12/1956 | Tieri | 16/128 A |
| D181,067 | 9/1957 | Reichow | 131/239 X |

FOREIGN PATENTS OR APPLICATIONS

| | | | |
|---|---|---|---|
| 687,571 | 4/1930 | France | 131/175 |

*Primary Examiner*—Louis G. Mancene
*Assistant Examiner*—John F. Pitrelli
*Attorney, Agent, or Firm*—Eugene M. Eckelman

[57] ABSTRACT

A casing has an end wall adapted to receive a cigarette holder for holding a cigarette internally of the casing. Removable and disposable astrays are held under the cigarette holder. Also provided in the casing is a cigarette lighter and a compartment to store a package of cigarettes. The cigarette holder is held in the casing in an arrangement such that it cannot be removed by the smoker but is adjustable longitudinally to accommodate cigarettes of different lengths. The casing has a hinged lid adapted to be locked in closed position to prevent access thereto if desired. Vent means are provided to allow the desired circulation of air.

4 Claims, 6 Drawing Figures

SAFETY SMOKING DEVICE

This is a continuation of application Ser. No. 425,155, filed Dec. 17, 1973, now abandoned.

BACKGROUND OF THE INVENTION

This invention relates to new and useful improvements in safety smoking devices.

Devices have heretofore been provided for enclosing a cigarette while being smoked. Exemplary devices are shown in U.S. Pat. Nos. 2,108,218 and 1,864,400. While such devices can be seated on a table or carried and smoking achieved without the cigarette being exposed they have certain inherent disadvantages. One disadvantage is that the person smoking the cigarette can easily gain access into the device. This frequently is undesirable since the person who must use a device of the present invention is one who is incompetent or incapacited to the extent that he should not handle a lighted cigarette, whether or not he is in bed. Another disadvantage of prior devices is that they do not make provision for holding cigarettes of different lengths which as is apparent is almost a required structural feature in view of the different cigarette lengths now in use.

SUMMARY OF THE INVENTION

According to the present invention and forming a primary objective thereof, a safety smoking device is provided which not only encloses a cigarette for safety in smoking but also provides a novel locking lid on the device which is capable of making the interior of the casing and therefore the cigarette inaccessible to a smoker.

Another object is to provide a safety smoking device which employes an adjustable holder for the cigarette to accommodate cigarettes of different lengths.

Other objects of the invention are to provide a safety smoking device of the type described having an inner compartment which holds a package of cigarettes, which incorporates a cigarette lighter, and which is of a structure capable of utilizing a plurality of stacked disposable ashtrays. Another object is to provide a safety smoking device of the type described which is simplified in structure and inexpensive to manufacture.

The invention will be better understood and additional objects and advantages will become apparent from the following description taken in connection with the accompanying drawings which illustrate a preferred form of the device.

DETAILED DESCRIPTION OF A PREFERRED EMBODIMENT

Figure 1:
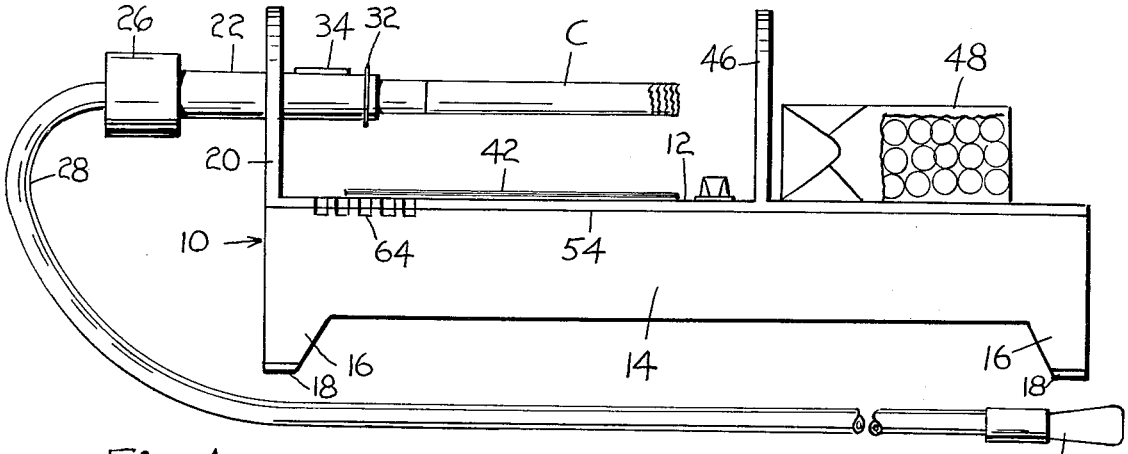
FIG. 1 is a side elevation view of the present safety smoking device; the lid thereof being open and not being visible in the view.
Figure 2:
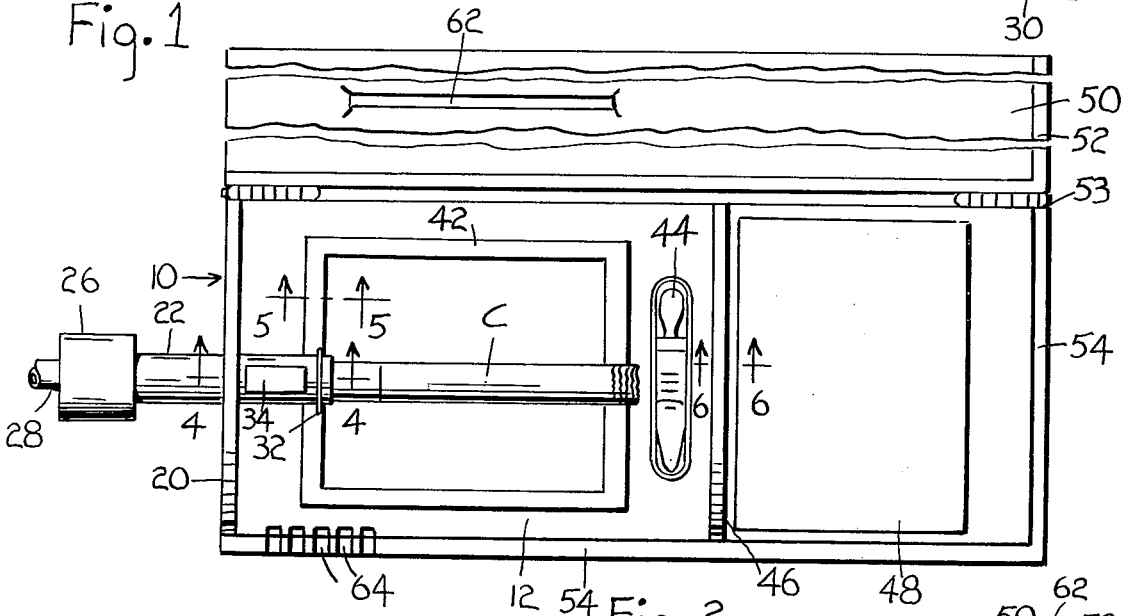
FIG. 2 is a top plan view of the safety smoking device, the lid being foreshortened through its width.
Figure 3:
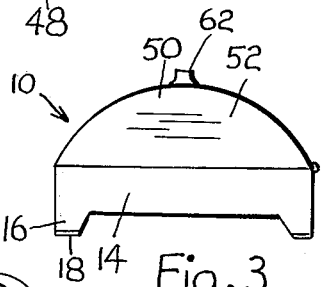
FIG. 3 is an end view in reduced scale taken from the right side of FIG. 2 and showing the lid in closed position.

With particular reference to the drawings, and first to FIGS. 1, 2 and 3, this safety smoking device comprises a casing 10 employing a bottom wall 12 integral with depending side and end flanges 14. Corner legs 16 are provided for seating the device on a table or other supporting surface, and if desired the bottom of the legs 16 may have felt pads 18 or the like to prevent damage to the supporting surface.

Integral with the bottom wall 12 at one end of the casing is an end wall 20 having a rounded upper edge. Projecting through the end wall 20 is a cigarette holder 22 which comprises a tubular body portion slidably supported in an aperture 24, FIG. 4, in the end wall 20. The holder 22 has a fitting 26 at its outer end adapted for connection to a flexible hose 28 provided with a smoking tip 30 at its free end.

The forward end of cigarette holder 22 is adapted to receive a cigarette C merely by frictional engagement of the butt end of the cigarette therein. A keeper 32 is mounted on the holder adjacent the forward end thereof. This keeper has an outer diameter larger than the outer diameter of the holder and the diameter of aperture 24 to prevent withdrawal of the holder from the end wall. The keeper may comprise merely a lock ring seated in a suitable groove in the outer surface of the holder, such structure providing for easy assembly of the holder in the housing and yet preventing accidental and even intentional withdrawal of the holder from the casing the purpose of which will be described more fully hereinafter.

Figure 4:
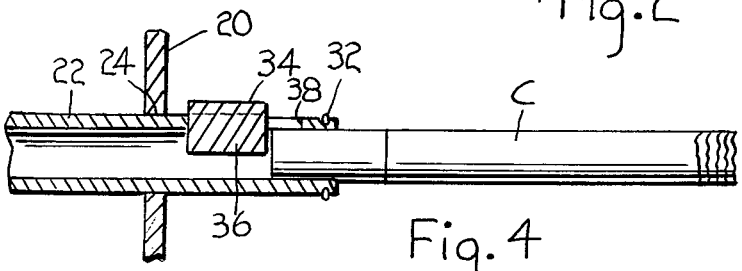
FIG. 4 is an enlarged fragmentary sectional view taken on the line 4—4 of FIG. 2.

With particular reference to FIGS. 1, 2, and 4, the holder has an ejector therein comprising a top flat tab 34 and an integral tongue portion 36 extending down from the tab through a slot 38 in the top wall of the holder 22 to a point in the longitudinal plane of the cigarette, this slot being of a length to provide forward and rearward movement of the ejector such that in the rearward position of the latter a cigarette can be installed in the holder and by movement thereof forwardly the cigarette butt is pushed out of the holder.

Figure 5:
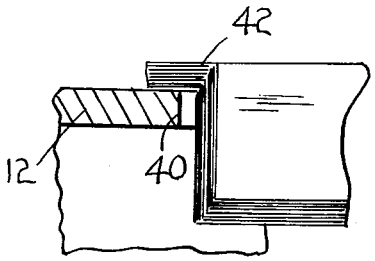
FIG. 5 is an enlarged fragmentary sectional view taken on the line 5—5 of FIG. 2.

Disposed below the forward end of the holder 22 in the area at which a cigarette would be supported is an aperture 40, FIG. 5, in the bottom wall 12. This aperture is arranged to support ashtray means 42 which in a preferred arrangement comprises a plurality of thin individual ashtrays stacked together in interfitted position whereby it is merely necessary when the top ashtray is full for the attendant to lift it out of the stack to provide a fresh receptacle. The ashtrays may if desired be constructed of inexpensive material and thus be disposable. A cigarette lighter 44 is mounted in the bottom wall adjacent to the ashtray. This lighter may or may not be removable.

Intermediate the ends of the bottom wall is an upstanding partition 46 rounded at its upper edge similar in shape and vertical dimension to end wall 20. The area of the bottom wall 12 opposite the partition 46 from the holder 22 serves as storage area for a package of cigarettes 48.

The casing is covered by a domed lid 50, such lid having a suitable curvature to seat on the end wall 20 as well as on the parition 46 and also having an end wall 52 at the end of the casing opposite from the end wall 20 so that when the lid is closed the interior of the casing is completely enclosed. The lid preferably is hinged, such as by pin-type hinges 53 on one side and when closed has engagement by its free edge with a shoulder 54 on the casing extending along the one longitudinal side for engagement by the longitudinal edge of the lid and along the one end for engagement by the edge of wall 52 of the lid.

Figure 6:
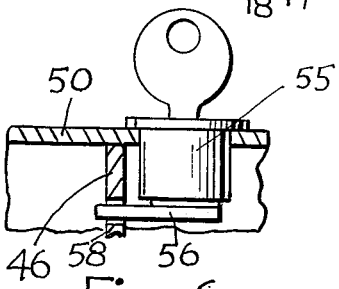
FIG. 6 is an enlarged fragmentary sectional view taken on the line 6—6 of FIG. 2 but with the lid in closed position.

Mounted in the lid is a key operated lock 55, FIG. 6, the locking latch 56 of which is located and arranged for releasable engagement with an aperture 58 in the partition 46. With the latch 56 engageable in the aperture 58, the patient cannot obtain access to the interior of the casing without the key.

It is desirable that the hinges 53 for the lid be nonremovable, or at least nonremovable without a proper tool, so that they cannot be taken out without such tool. For this purpose, the hinge pins thereof may have a press fit into one of the hinging members in a well known manner.

The lid has vent means to allow for the inlet of air and the outlet of smoke, and for this purpose an exhaust vent 62 is provided in the top of the lid in the area above the ashtray. Also, notches 64 are cut in the bottom wall at the one side along the shoulder 54, such notches being cut in the bottom of shoulder 54 in the smoking area and into the side edge of wall 12 adjacent to the shoulder to provide ports establishing communication of the inside of the casing with the outside.

According to the invention, the casing can be seated on a table or the like and a cigarette smoked by a person in bed, in a chair, or the like. The lid may be open or closed as desired but the device has the advantage that the lid may be locked closed and the key removed if it is desired that the smoker not have access to the cigarette being smoked. The locking of the lid also has the advantage that the package of cigarettes 48 stored therein is not available to the smoker or unauthorized personnel.

The holder 22 is adjustable longitudinally to accommodate the length of cigarette used by the smoker, and with the ejector 34, provides for easy removal of the cigarette butt when it has been smoked down.

It is to be understood that the form of my invention herein shown and described is to be taken as a preferred example of the same and that various changes in the shape, size and arrangement of parts may be resorted to without departing from the spirit of my invention, or the scope of the subjoined claims.

Having thus described my invention, I claim:

1. A safety smoking device arranged to permit a person to smoke a cigarette but to prevent such person from having access to such cigarette, such device comprising, a. a casing having a bottom wall and enclosing side, end and top walls, b. support means on said casing for seating it on a supporting surface in its use, c. said bottom wall having an aperture adjacent one end of the casing, d. flanged ashtray means seated on said bottom wall in depending relation in said aperture, e. cigarette holding means mounted in an end wall of said casing which is adjacent said aperture for the ashtray means, f. said cigarette holding means being arranged to hold a cigarette over said ashtray means, g. means locking said cigarette holding means in said end wall so as to be non-removable by the smoker, h. said cigarette holding means having an end portion thereof projecting outwardly of said casing, i. a flexible tube mounted at one of its ends on said projecting end of said cigarette holding means, j. a smoking tip on the other end of said flexible tube, k. said casing including a lid forming a part of said enclosing walls, l. and key operated lock means in said lid arranged to lock it closed on said casing for preventing access to the interior of the casing by the smoker.

2. The safety smoking device of claim 1 wherein said cigarette holding means comprises a tubular member slidably mounted in said one end wall for adjustment relative to said ashtray to accommodate cigarettes of different lengths, and stop means on said cigarette holding means arranged to limit outward sliding movement of said holding means to maintain it locked on the casing.

3. The safety smoking device of claim 1 including means in said casing for holding a cigarette lighter.

4. The safety smoking device of claim 1 including means defining a compartment adjacent the end opposite from said cigarette holding means for holding a package of cigarettes for storage.

* * * * *